US007704085B1

(12) United States Patent
Chang

(10) Patent No.: US 7,704,085 B1
(45) Date of Patent: Apr. 27, 2010

(54) COVER MODULE OF ELECTRONIC DEVICE AND CONTROL METHOD THEREOF

(75) Inventor: Chin-Hsien Chang, Taipei (TW)

(73) Assignee: Compal Electronics, Inc., Taipei (TW)

( * ) Notice: Subject to any disclaimer, the term of this patent is extended or adjusted under 35 U.S.C. 154(b) by 0 days.

(21) Appl. No.: 12/497,539

(22) Filed: Jul. 2, 2009

(30) Foreign Application Priority Data

Apr. 7, 2009 (TW) ..... 98111498 A

(51) Int. Cl.
*H01R 13/44* (2006.01)

(52) U.S. Cl. ..... 439/137; 439/928.1

(58) Field of Classification Search ..... 439/135–137, 439/928.1; 361/728–730; 174/50.52
See application file for complete search history.

(56) References Cited

U.S. PATENT DOCUMENTS 6,377,451 B1 4/2002 Furuya
6,747,877 B2 * 6/2004 Tonozuka ..... 361/797
7,104,817 B2 * 9/2006 Shiue et al. ..... 439/137
7,264,491 B2 * 9/2007 McBroom et al. ..... 439/160

* cited by examiner

*Primary Examiner*—Khiem Nguyen
(74) *Attorney, Agent, or Firm*—Jianq Chyun IP Office

(57) ABSTRACT

A cover module of an electronic device and a control method thereof are provided. The cover module includes a body, a flexible connecting element, and a flip cover. The body has an opening exposing the connector. A sidewall of the opening has a first fixing structure. The flip cover is in the opening, and a sidewall of the flip cover has a second fixing structure locked with the first fixing structure. The flexible connecting element is connected between the body and the flip cover. When a force is applied to the flip cover, the flexible connecting element is deformed, the flip cover moves with the deformation of the flexible connecting element, and the locking between the first and the second fixing structures is released to cause the flip cover swinging open away from the body with a part of the flexible connecting element as an axis.

12 Claims, 12 Drawing Sheets

COVER MODULE OF ELECTRONIC DEVICE AND CONTROL METHOD THEREOF

CROSS-REFERENCE TO RELATED APPLICATION

This application claims the priority benefit of Taiwan application serial no. 98111498, filed on Apr. 7, 2009. The entirety of the above-mentioned patent application is hereby incorporated by reference herein and made a part of specification.

BACKGROUND OF THE INVENTION

1. Field of the Invention

The present invention generally relates to a cover, and more particularly, to a cover module assembled with an electronic device.

2. Description of Related Art

Nowadays, electronic devices are usually designed very small, slim, and light therefore can be conveniently carried around by users. For example, many users like to bring their notebook computers when they are on business trip or vacation because notebook computers can provide many different functions, such as text editing, report generating, networking, instant messenger, and e-mail box, etc.

However, because there are many dust particles in the outdoor environment and the ports on a connector of a notebook computer are exposed by the casing of the notebook computer, the dust particles may accumulate in the connector and accordingly affect the connections between the connector and other external devices. In particular, the dust particles may even cause short circuit between the connector and the external devices or even damage the connector and the external devices.

In order to resolve foregoing problems, conventionally, a cover is provided, and a user can assemble the cover with a notebook computer when the notebook computer is not in use, so that the cover can cover the connector of the notebook computer and accordingly prevent dust particles from accumulating in the connector. In addition, the cover can also protect the connector of the notebook computer from unwanted foreign substances.

FIG. 1 is a diagram of a conventional cover and a connector of an electronic device. Referring to FIG. 1, the housing 43 has an open slot 6. When the electronic device is placed in the housing 43, the open slot 6 exposes a connector 5C of the electronic device. In order to prevent foreign substances (for example, dust particles) from entering the connector 5C, two blocking covers 3 and 4 are disposed for hiding the connector 5C. Besides, the blocking covers 3 and 4 are connected to a hinge 51 so that the blocking covers 3 and 4 can hide the connector 5C normally.

When an external device is to be electrically connected to the electronic device through the connector 5C, a user pushes the plug 34 of the external device toward the connector 5C. The plug 34 first pushes the blocking covers 3 and 4. Herein the blocking covers 3 and 4 respectively rotate around the axles 10*a* and 11*a* and drive the ends of the hinge 51 so that the plug 34 can enter the open slot 6 and be plugged to the connector 5C. When the user wants to cut off the electrical connection between the external device and the electronic device, the user pulls the plug 34 out of the connector 5C in a reverse direction. Herein the blocking covers 3 and 4 are restored to their original positions by the resilience of the hinge 51.

However, because the hinge 51 is usually made of a twisted metal bar, the user has to apply a very big force to push the blocking covers 3 and 4 with the plug 34 and accordingly drive the hinge 51. Besides, because the blocking covers 3 and 4 require a gyration radius when they are opened, some space in the housing 43 is wasted, and which is not very economically beneficial.

SUMMARY OF THE INVENTION

Accordingly, the present invention is directed to an economically beneficial cover module.

The present invention provides a cover module suitable for being assembled with an electronic device for protecting a connector of the electronic device. The cover module includes a body, a flip cover, and a flexible connecting element. The body has an opening for exposing the connector. A sidewall of the opening has a first fixing structure. The flip cover is located in the opening, and a sidewall of the flip cover has a second fixing structure locked with the first fixing structure. The flexible connecting element is connected between the body and the flip cover. When a force is applied to the flip cover, the flexible connecting element is deformed, the flip cover moves with the deformation of the flexible connecting element, and the locking between the first fixing structure and the second fixing structure is released to cause the flip cover swinging open away from the body with a part of the flexible connecting element as an axis.

According to an embodiment of the present invention, the first fixing structure is a flange, and the second fixing structure is a recess.

According to an embodiment of the present invention, the first fixing structure is a recess, and the second fixing structure is a flange.

According to an embodiment of the present invention, the first fixing structure has a first guiding surface and a second guiding surface, wherein the first guiding surface and the second guiding surface form an acute angle; the second fixing structure has a third guiding surface and a fourth guiding surface, wherein the third guiding surface and the fourth guiding surface form an acute angle; and when the first fixing structure and the second fixing structure are locked with each other, the second guiding surface contacts the fourth guiding surface.

According to an embodiment of the present invention, the body is made of polycarbonate (PC), acrylonitrile-butadiene-styrene terpolymer (ABS), or metal.

According to an embodiment of the present invention, the flexible connecting element is made of rubber.

According to an embodiment of the present invention, the body is a casing of part of the electronic device.

According to an embodiment of the present invention, the body, the flip cover, and the flexible connecting element are formed integrally.

According to an embodiment of the present invention, the flip cover further has a plurality of protruding structures corresponding to the second fixing structure, and when the first fixing structure and the second fixing structure are locked with each other, the protruding structures hide both the first fixing structure and the second fixing structure.

According to an embodiment of the present invention, part of the flip cover and part of the body are made of rubber.

According to an embodiment of the present invention, the flip cover has a supporting structure for enhancing the intensity of the flip cover.

According to an embodiment of the present invention, the flexible connecting element is connected to a surface of the body and a surface of the flip cover.

The present invention further provides a method for controlling a cover module of an electronic device, wherein the method can protect a connector of the electronic device. The method includes following steps. An external force is applied to a flip cover on the cover module to release the locking between a second fixing structure on the flip cover and a first fixing structure on a body of the cover module and deform a flexible connecting element connected to the body and the flip cover, wherein the first fixing structure is located on a sidewall of an opening, and the opening is located on the body. The flip cover is then rotated with part of the flexible connecting element as an axis, so that the flip cover is opened relatively to the body and the connector is exposed at the opening.

According to an embodiment of the present invention, the method for releasing the locking between the second fixing structure and the first fixing structure includes making a guiding surface of the second fixing structure being guided along a guiding surface of the first fixing structure until the guiding surface of the second fixing structure exceeds the guiding surface of the first fixing structure.

In the cover module provided by the present invention, a flexible connecting element is disposed between a body and a flip cover. A user can deform the flexible connecting element because of a material of the flexible connecting element is softer and accordingly release the locking between the flip cover and the body by applying a very small force. In addition, the connector can be effectively hidden through the locking between a first fixing structure on the body and a second fixing structure on the flip cover. Moreover, no space is wasted when the cover module is assembled with an electronic device. Thereby, the cover module is very economically beneficial.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
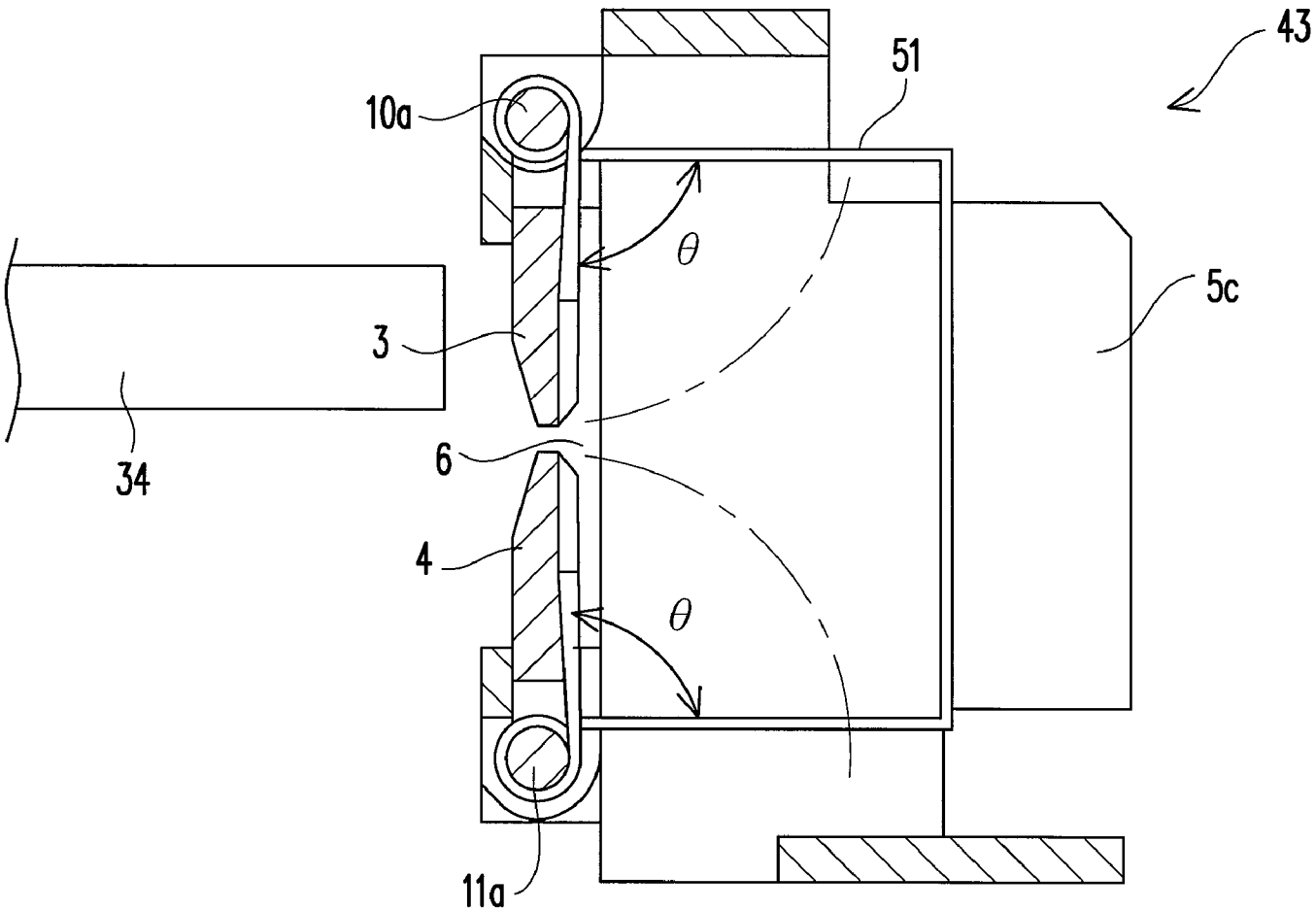
FIG. 1 (RELATED ART)
FIG. 1 is a diagram of a conventional cover and a connector of an electronic device.

Reference will now be made in detail to the present preferred embodiments of the invention, examples of which are illustrated in the accompanying drawings. Wherever possible, the same reference numbers are used in the drawings and the description to refer to the same or like parts.

Figure 2:
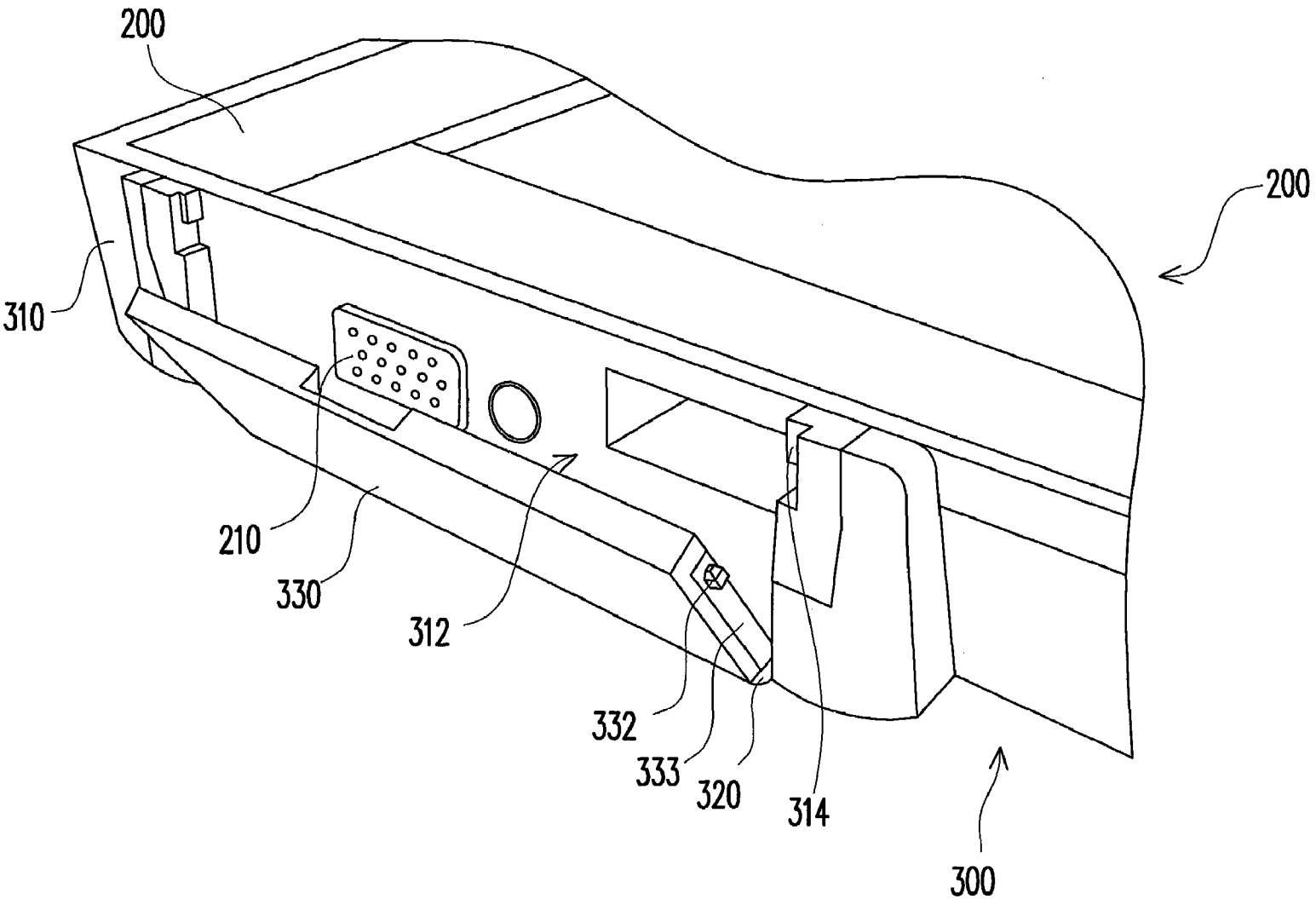
FIG. 2 is a diagram of a cover module assembled with an electronic device according to an embodiment of the present invention.
Figure 3:
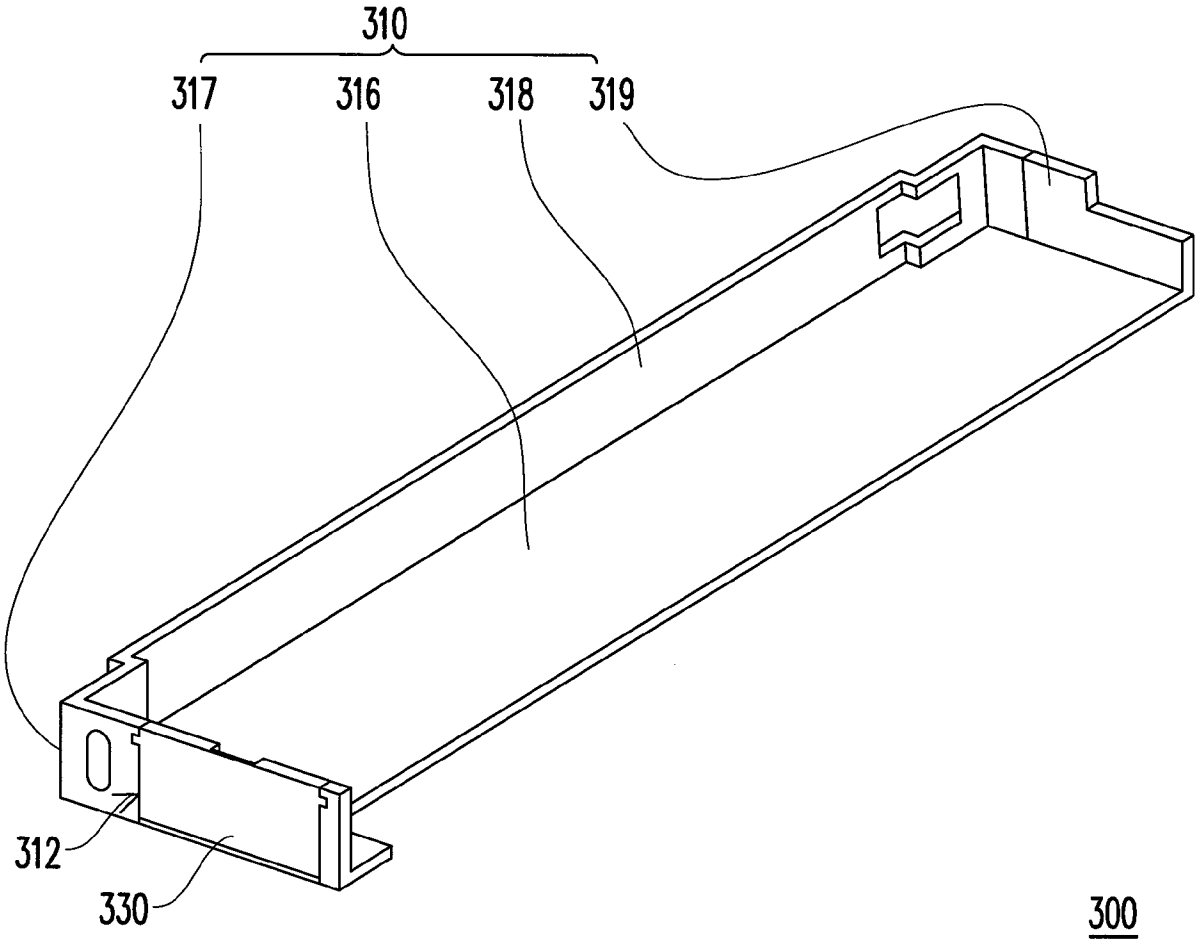
FIG. 3 is a diagram of the cover module in FIG. 2.
Figure 4:
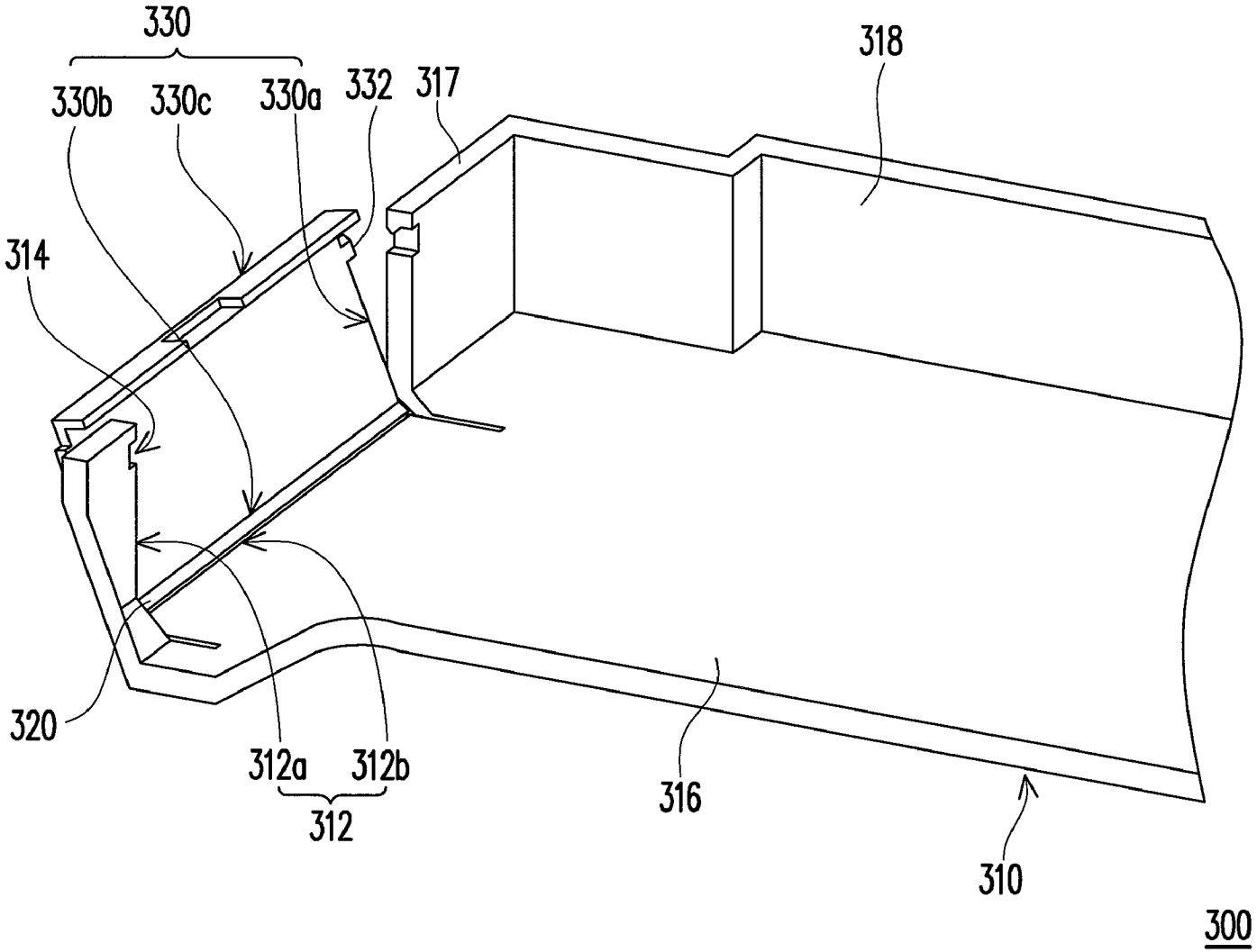
FIG. 4 is a partial view illustrating how a flip cover is opened relatively to a body in the cover module in FIG. 2.
Figure 5:
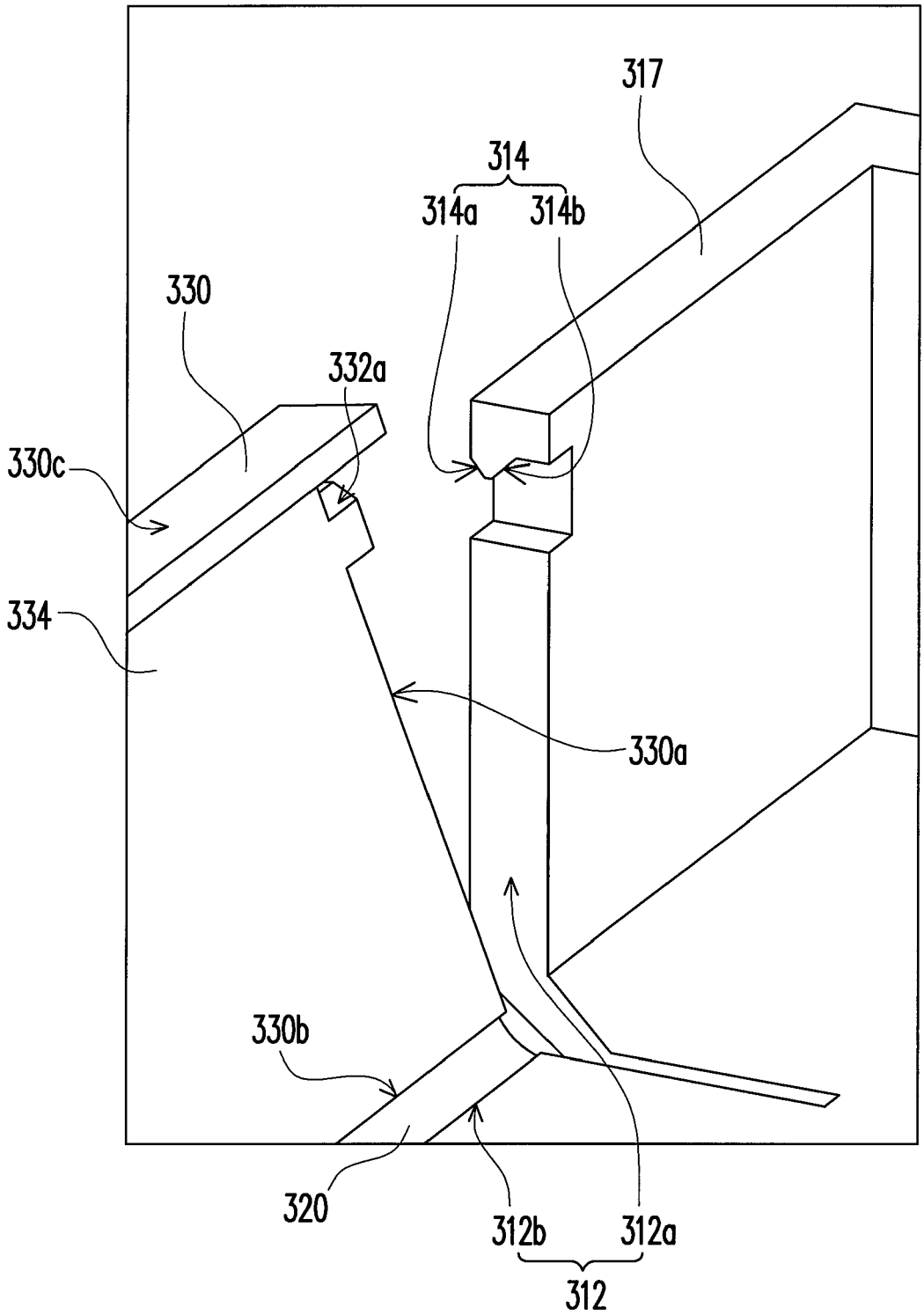
FIG. 5 is an enlarged partial view of the cover module in FIG. 4.

FIG. 2 is a diagram of a cover module assembled with an electronic device according to an embodiment of the present invention, and FIG. 3 is a diagram of the cover module in FIG. 2. Referring to both FIG. 2 and FIG. 3, the cover module 300 is used for covering and protecting a connector 210 of the electronic device 200. Referring to FIG. 2, the electronic device 200 is a notebook computer. However, the type of the electronic device 200 is not limited in the present invention. FIG. 4 is a partial view illustrating how a flip cover of the cover module in FIG. 2 is opened relatively to a body, and FIG. 5 is an enlarged partial view of the cover module in FIG. 4. Referring to FIG. 3, FIG. 4, and FIG. 5, the cover module 300 includes a body 310, a flexible connecting element 320, and a flip cover 330. The body 310 has an opening 312 for exposing the connector 210 (as shown in FIG. 2), and a sidewall (not shown) of the opening 312 has a first fixing structure 314. The flexible connecting element 320 is connected between the body 310 and the flip cover 330, and the flip cover 330 is located in the opening 312. A sidewall (not shown) of the flip cover 330 has a second fixing structure 332 suitable for being locked with the first fixing structure 314. In a different product design, the body 310 may be a part of casing of the electronic device 300, and the flip cover 330 may further include a supporting structure 333, wherein the supporting structure 333 is disposed on an internal surface of the flip cover 330 facing the casing for enhancing the intensity of the flip cover 330, and the second fixing structure 332 may be further disposed on the supporting structure. When a force is applied to the flip cover 330, the locking between the first fixing structure 314 and the second fixing structure 332 is released and the flexible connecting element 320 is deformed. The flip cover 330 moves along with the deformation of the flexible connecting element 320, and the flip cover 330 rotates with part of the flexible connecting element 320 as an axis to be opened relatively to the body 310. A user can apply smaller force to deform the flexible connecting element 320 connected between the body 310 and the flip cover 330 so as to release the locking between the flip cover 330 and the body 310 because the flexible connecting element 320 is made of a softer material. Accordingly, the user can use the connector 210 (as shown in FIG. 2) conveniently.

Specifically, the body 310 may be made of polycarbonate (PC), acrylonitrile-butadiene-styrene terpolymer (ABS), or metal according to the actual requirement. The body 310 includes a bottom wall 316 and at least three sidewalls 317, 318, and 319, wherein the sidewalls 317, 318 and 319 are located at the same side of the bottom wall 316, the sidewalls 317 and 319 are parallel to each other, and the sidewall 318 is connected between the sidewall 317 and the sidewall 319 perpendicularly. Besides, the sidewalls 317 and 319 in FIG. 3 respectively have an opening 312. The openings 312 can be selectively disposed on the three sidewalls 317, 318 and 319 by those having ordinary knowledge in the art according to the actual requirement, and the positions and the numbers of the openings 312 are not limited in the present invention.

Figure 6:
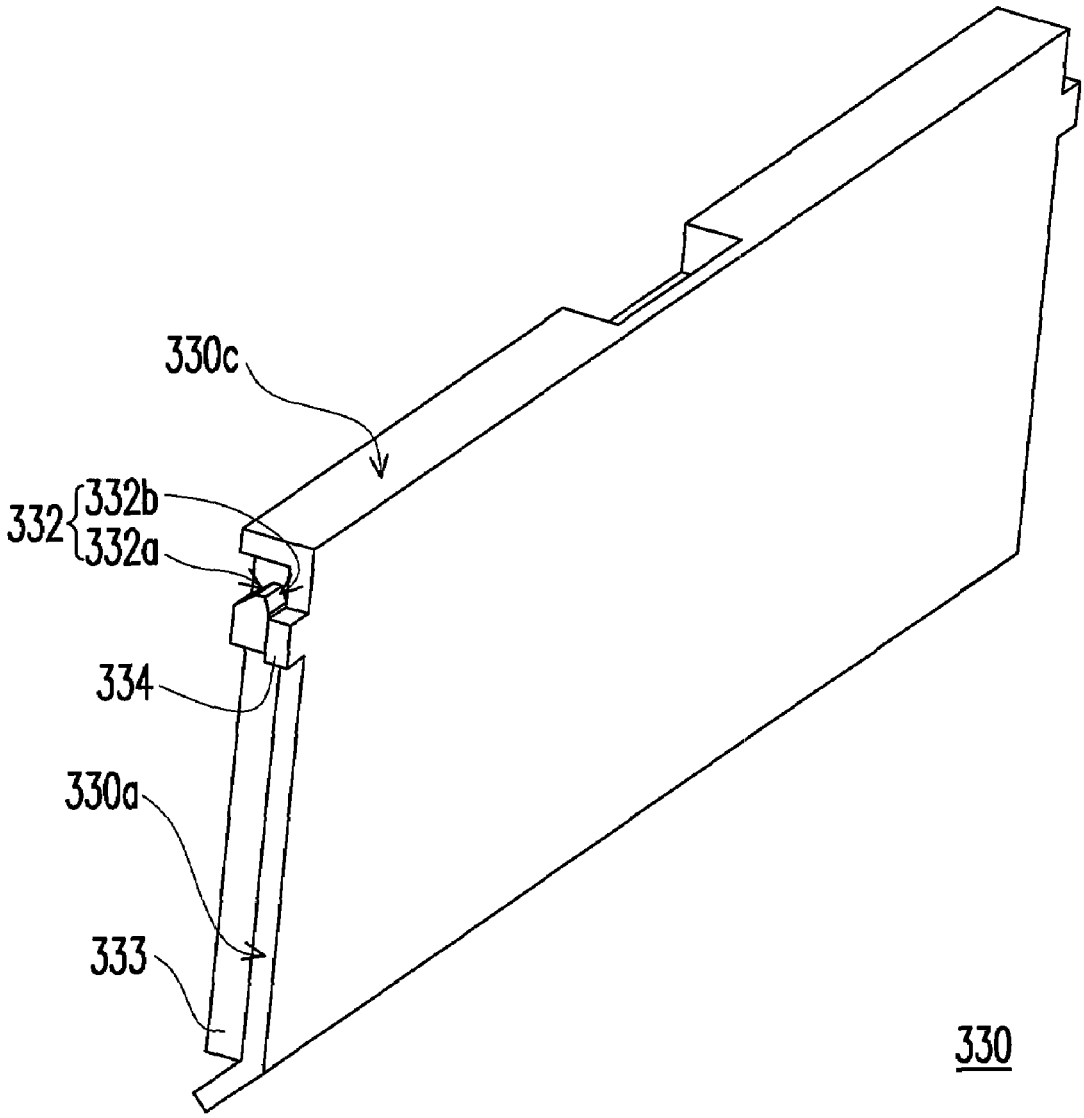
FIG. 6 is a diagram of a flip cover.
Figure 7:
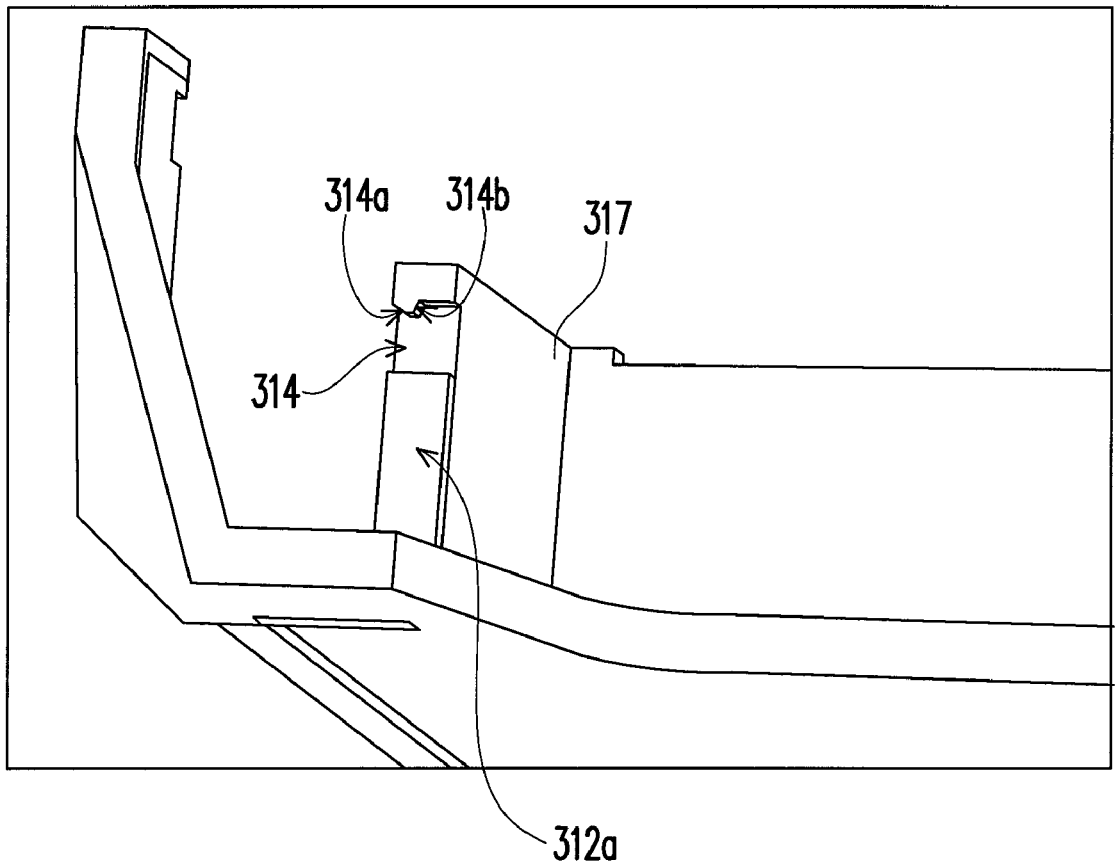
FIG. 7 is an enlarged view of an opening on a body.

Referring to FIG. 4 and FIG. 5, the opening 312 has two first sides 312*a* opposite to each other and a surface 312*b* perpendicularly connected between the first sides 312*a*, and the first fixing structure 314 is correspondingly located at the first sides 312*a*. The flip cover 330 has two second sides 330*a* opposite to each other and a surface 330*b* perpendicularly connected between the two second sides 330*a*. The flexible connecting element 320 made of rubber is connected to the surface 312*b* and the surface 330*b*, and the second fixing structure 332 is correspondingly located at the second sides 330*a*. In short, a first fixing structure 314 is correspondingly disposed on each of the first sides 312*a*, and a second fixing structure 332 is correspondingly disposed on each of the second sides 330*a*. The first fixing structures 314 and the second fixing structures 332 are located close to a top side 330*c* of the flip cover 330, wherein the top side 330*c* is also perpendicularly connected between the two parallel second sides 330*a* and is opposite to the surface 330*b*. FIG. 6 is a diagram of a flip cover, and FIG. 7 is an enlarged view of an opening on a body. Referring to both FIG. 6 and FIG. 7, the first fixing structure 314 is a recess on the first side 312*a* of the side wall 317, and the second fixing structure 332 is a flange protruded from the second side 330*a*.

Figure 8:
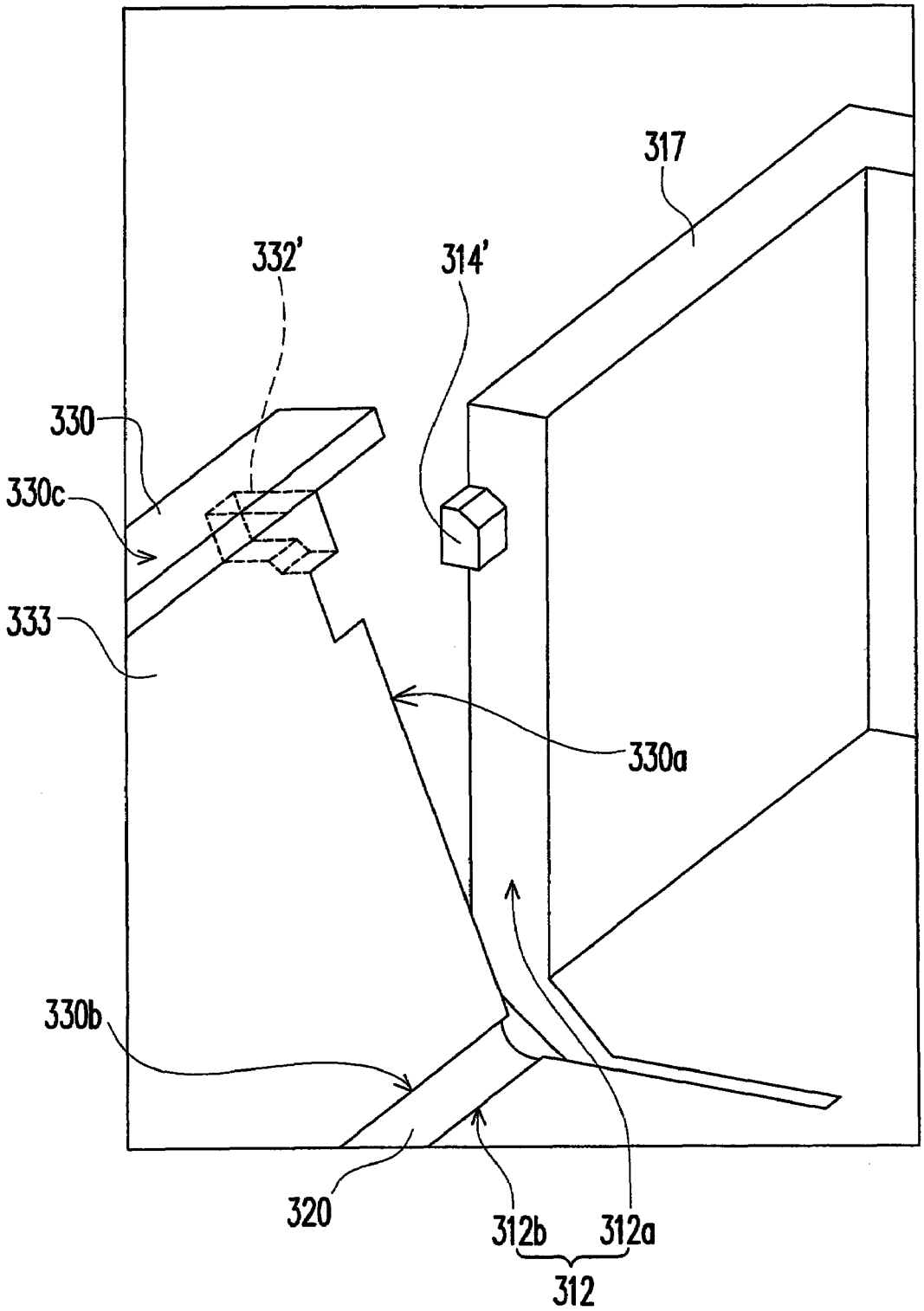
FIG. 8 is a diagram of a first fixing structure and a second fixing structure according to another embodiment of the present invention.

FIG. 8 is a diagram of a first fixing structure and a second fixing structure according to another embodiment of the present invention. Referring to FIG. 8, the shapes and locations of the first fixing structure and the second fixing structure can be determined according to the actual design. For example, the first fixing structure 314' may also be a flange while the second fixing structure 332' a corresponding recess, and the first fixing structure 312' and the second fixing structure 332' may be disposed close to the middle between the first sides 312*a* and the second sides 330*a*. However, the positions, shapes, and number of the first fixing structures and the second fixing structures are not limited in the present invention, and it is within the scope of the present invention as long as the first fixing structures and the second fixing structures can be locked with each other.

Referring to FIG. 6 and FIG. 7, the first fixing structure 314 has a first guiding surface 314*a* and a second guiding surface 314*b*, wherein there is an acute angle between the first guiding surface 314*a* and the second guiding surface 314*b*. The second fixing structure 322 has a third guiding surface 332*a* and a fourth guiding surface 332*b*, wherein there is an acute angle between the third guiding surface 332*a* and the fourth guiding surface 332*b*. Besides, the flip cover 330 may further have a plurality of protruding structures 334 corresponding to the second fixing structure 332. When the first fixing structure 314 and the second fixing structure 322 are locked with each other, the protruding structures 334 hide both the first fixing structure 314 and the second fixing structure 322 to improve the appearance of the cover module 300.

In the present embodiment, the body 310, the flexible connecting element 320, and the flip cover 330 are formed integrally. Specifically, while forming the cover module 300, a harder material (for example, PC, ABS, or metal) is first filled into the mold to form the body 310 and the flip cover 330, and then a softer material, such as rubber, is filled into the mold to form the flexible connecting element 320. After that, the cover module 300 is released from the mold. In addition, part of the flip cover 330 and part of the body 310 may also be made of rubber according to the actual requirement. Compared to the conventional technique, the cover module 300 in the present embodiment is easy to fabricate and requires no additional hinge or blocking door. Thus, the material cost and human labor are both reduced in the present invention.

Figure 9:
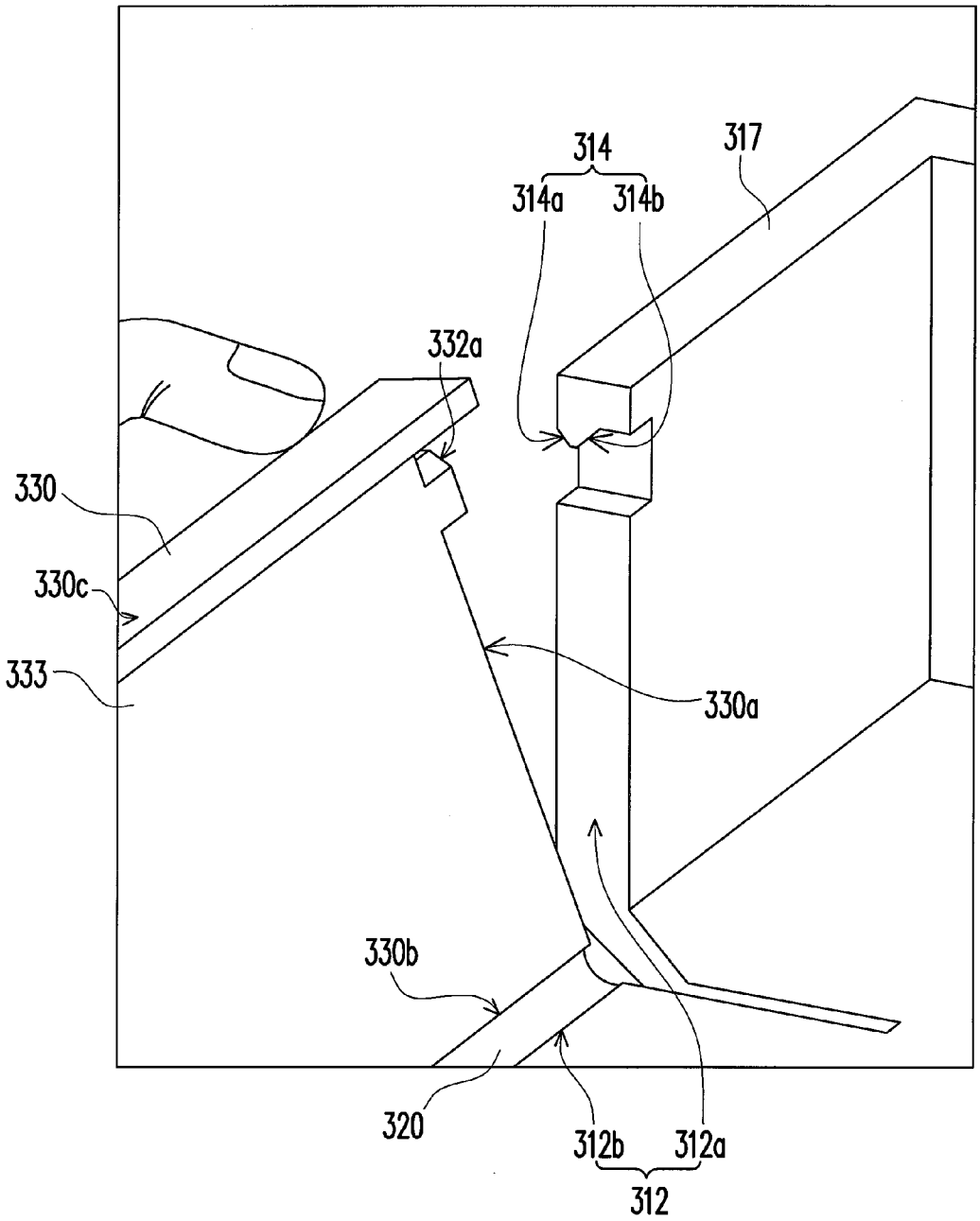
FIGS. 9~11 are diagrams illustrating how a flip cover is closed relatively to a body.
Figure 10:
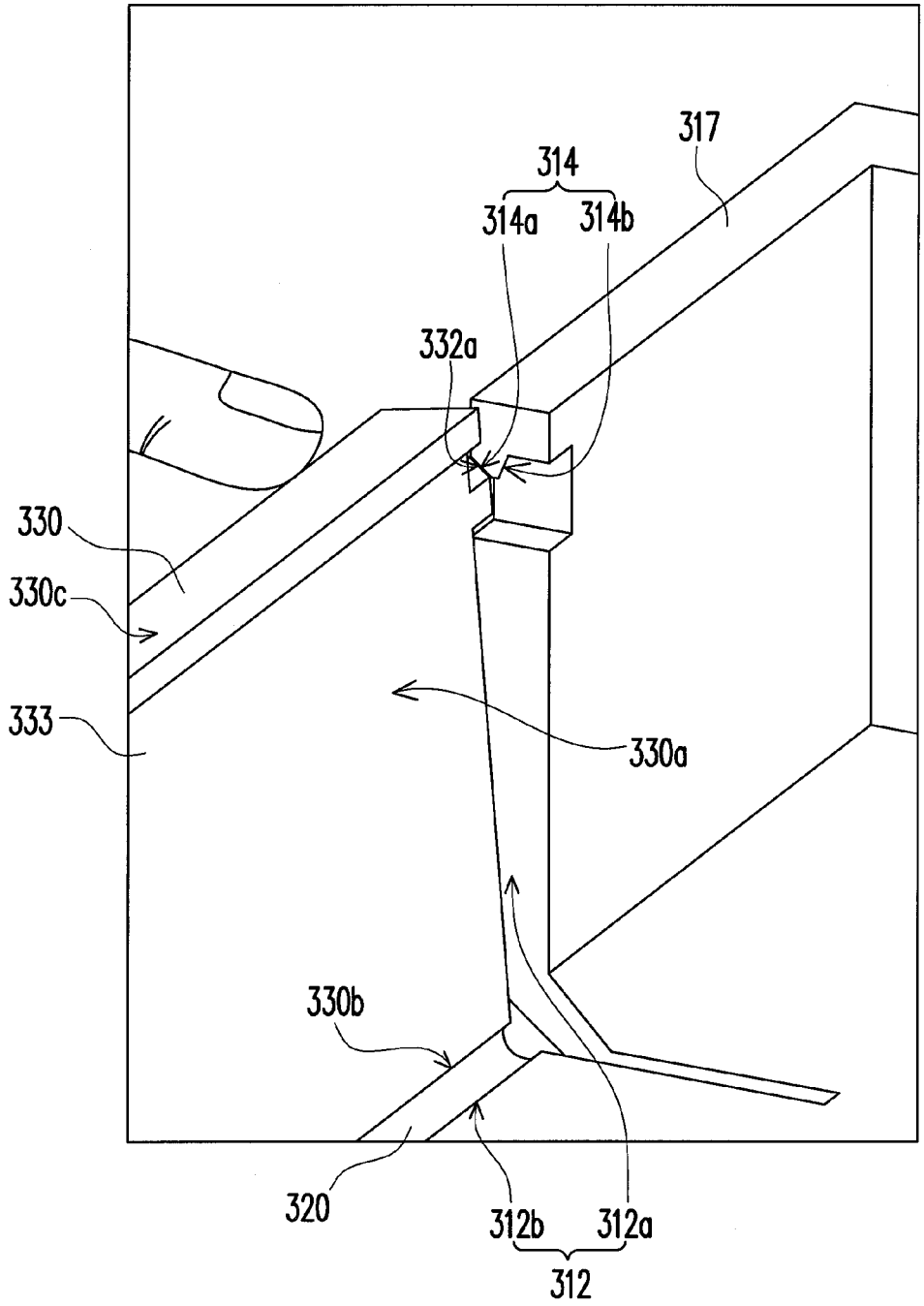
Figure 11:
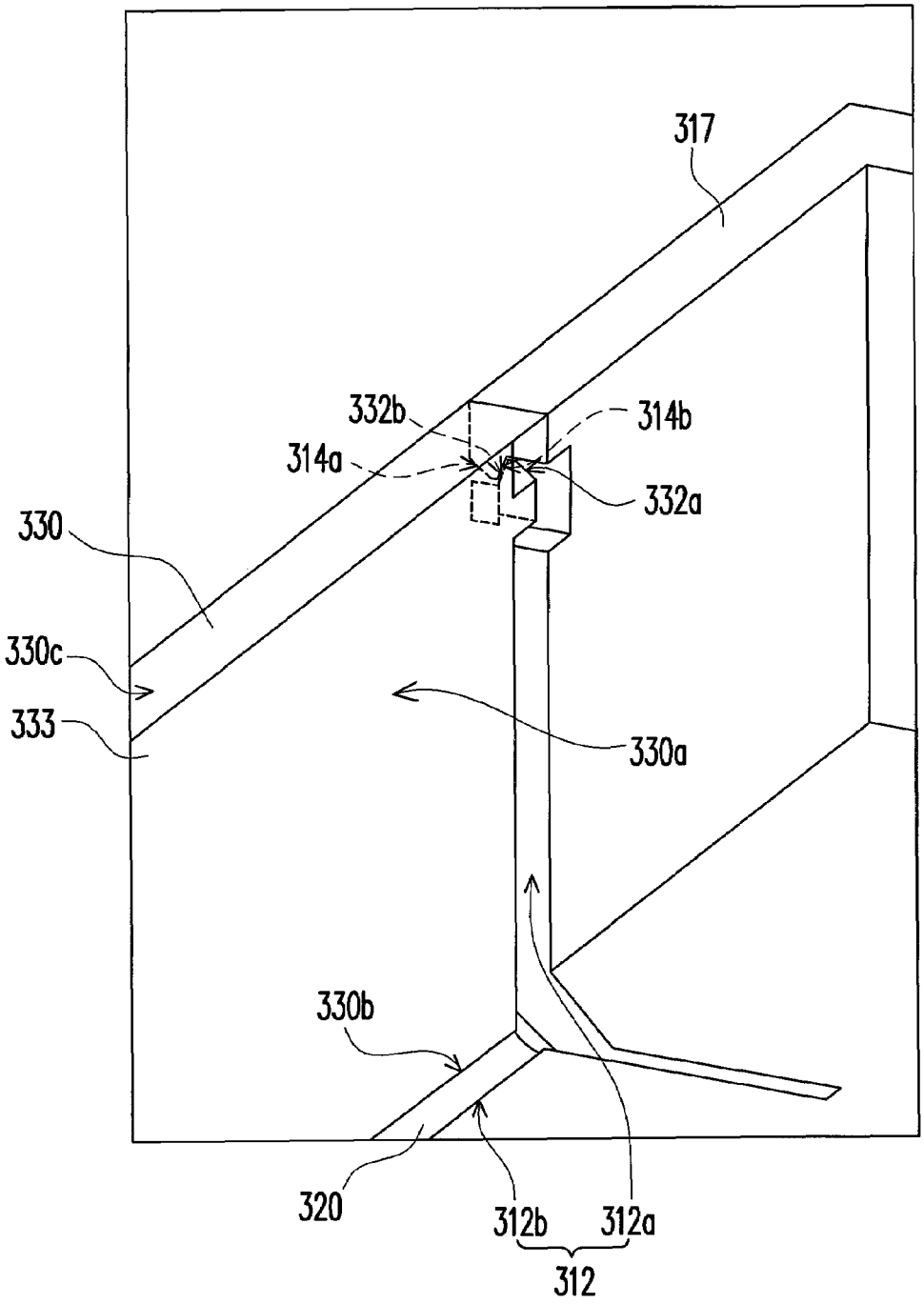

FIGS. 9~11 are diagrams illustrating how a flip cover is closed corresponding to a body. As shown in FIG. 9, when the flip cover 330 is not fixed to the opening 312, the opening 312 exposes the connector 210 (as shown in FIG. 2) of the electronic device 200. A user can move the flip cover 330 close to the body 310. More specifically, because the flexible connecting element 320 has one end connected to the surface 312*b* of the opening and the other end connected to the surface 330*b* of the flip cover 330, and the flexible connecting element 320 is made of softer rubber, the flexible connecting element 320 is deformed and the flip cover 330 gets close to the opening 312 correspondingly when the user applies a force on the flip cover 330. Besides, the flip cover 330 may also rotate relatively to the body 310 with the flexible connecting element 320 as an axis to eventually insert the flip cover 330 into the opening 312.

Next, as shown in FIG. 10, the force is constantly applied to the flip cover 330 to allow it to move toward the opening 312. When the third guiding surface 332*a* of the second fixing structure 322 contacts the first guiding surface 314*a* of the first fixing structure 314, the third guiding surface 332*a* moves along the first guiding surface 314*a* toward direction Z, and the flip cover 330 moves along with the third guiding surface 332*a* toward direction Z. As a result, the end of the flexible connecting element 320 connected to the surface 330*b* of the flip cover 330 also moves toward direction Z, so that the flexible connecting element 320 is deformed.

Thereafter, as shown in FIG. 11, after the third guiding surface 332*a* exceeds the first guiding surface 314*a*, the fourth guiding surface 332*b* and the second guiding surface 314*b* contact each other. Then, the user stops applying the force on the flip cover 330 so that the fourth guiding surface 332*b* is moved along the second guiding surface 314*b* by the resilience of the flexible connecting element 320. It should be mentioned that because the third guiding surface 332*a* and the fourth guiding surface 332*b* form an acute angle and the first guiding surface 314*a* and the second guiding surface 314*b* form an acute angle, the first fixing structure 314 and the second fixing structure 332 are locked with each other, and the locking won't be released until an external force is applied. Thus, the flip cover 330 is located in the opening 312 for hiding the connector 210 (as shown in FIG. 2) of the electronic device 200.

Contrarily, when the user wants to use the connector 210 (as shown in FIG. 2), the flip cover is opened relatively to the body in the reverse process, as shown from FIG. 11 to FIG. 9. The user simply applies a small force on the top side 330*c* of the flip cover 330 to move the flip cover 330 downward. Then, the flexible connecting element 320 is driven by the flip cover 330 to be deformed. When the fourth guiding surface 332*b* of the flip cover 330 moves along the second guiding surface 314*b* until the fourth guiding surface 332*b* exceeds the second guiding surface 314*b*, the locking between the second fixing structure 332 of the flip cover 330 and the first fixing structure 314 body 310 is released. After that, the flip cover 330 rotates with part of the flexible connecting element 320 as an axis to be opened relatively to the body 310, so that the connector 210 (as shown in FIG. 2) is exposed at the opening 312.

Figure 12:
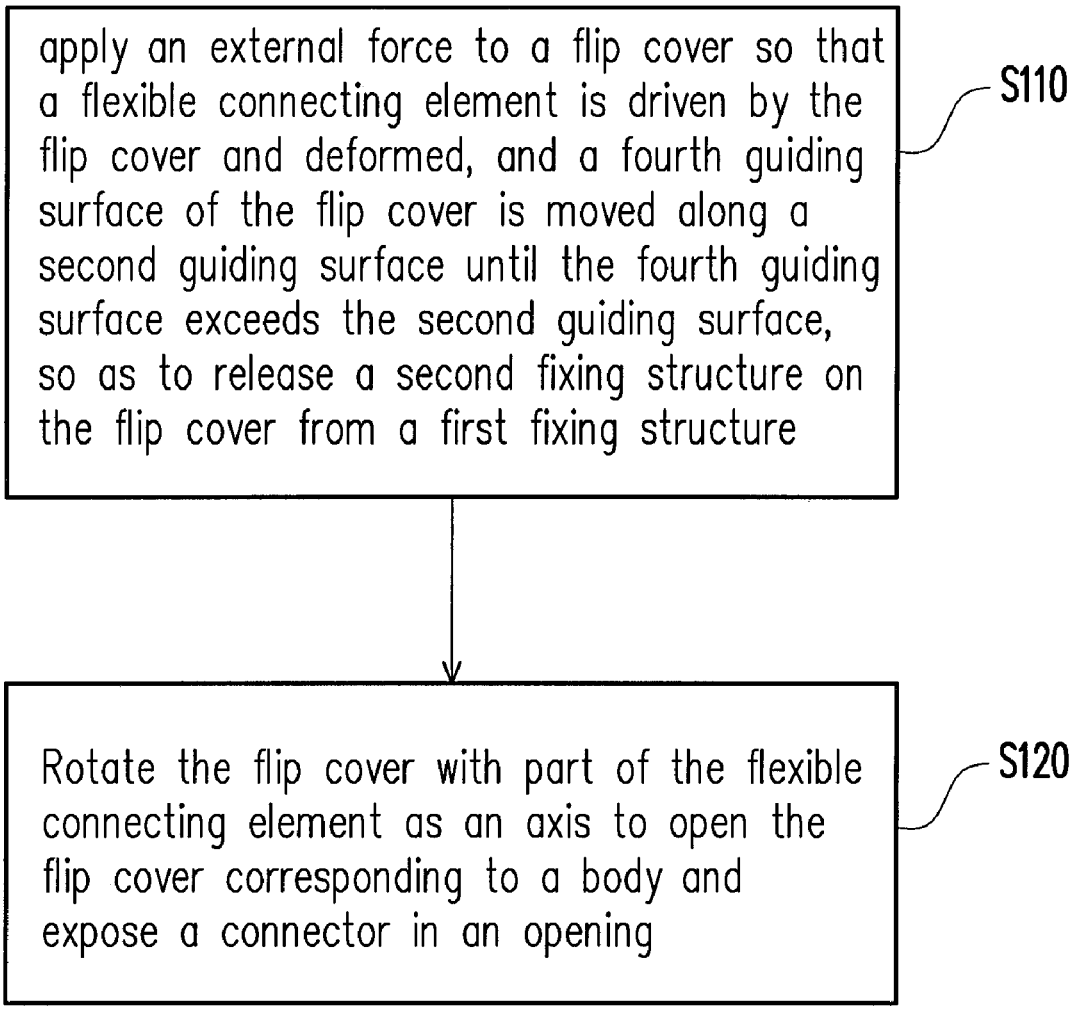
FIG. 12 is a flowchart of a method for controlling a cover module on an electronic device to protect a connector of the electronic device.

FIG. 12 is a flowchart of a method for controlling a cover of an electronic device to protect a connector of the electronic device. The method in the present invention includes following steps. In step S110, an external force is applied to a flip cover of the cover module, so that a second fixing structure on the flip cover is released from a first fixing structure located on a body of the cover module, and meanwhile, the flexible connecting element connected to the body and the flip cover is deformed, wherein the first fixing structure is located on a sidewall of an opening of the body. Then, in step S120, the flip cover is rotated with part of the flexible connecting element as an axis so that the flip cover is opened relatively to the body. As a result, the connector is exposed at the opening. When a user wants to close the opening, the user simply applies a force on the flip cover to deform the flexible connecting element and fix the first fixing structure with the second fixing structure, so as to close the opening and protect the connector.

As described above, when a user uses the cover module 300 in the present embodiment, the user opens or closes the flip cover 330 corresponding to the body 310, and the force that the user applies on the flip cover 330 is effectively reduced. In short, the cover in the present invention is much easier to operate compared to a conventional cover.

In overview, the cover module provided by the present invention can effectively hide a connector of an electronic device and prevent dust particles from accumulating in the connector or unnecessary foreign substances from entering the connector. Moreover, a user can open or close the flip cover corresponding to the body by simply applying a small force. Thus, it is more convenient and easy for the user to operate the cover module. Furthermore, the body, the flip cover, and the flexible connecting element can be formed integrally so that the fabrication process of the cover module can be simplified, and the material cost and human labour can be both reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A cover module, suitable for being assembled with an electronic device for protecting a connector of the electronic device, the cover module comprising:

a body, having an opening for exposing the connector, wherein a sidewall of the opening comprises a first fixing structure;

a flip cover, located in the opening, wherein a sidewall of the flip cover comprises a second fixing structure locked with the first fixing structure; and a flexible connecting element, connected between the body and the flip cover;

wherein when a force is applied to the flip cover, the flexible connecting element is deformed, the flip cover moves with the deformation of the flexible connecting element, and a locking between the first fixing structure and the second fixing structure is released to cause the flip cover swinging open away from the body with a part of the flexible connecting element as an axis.

2. The cover module according to claim 1, wherein the first fixing structure is a flange, and the second fixing structure is a recess.

3. The cover module according to claim 1, wherein the first fixing structure is a recess, and the second fixing structure is a flange.

4. The cover module according to claim 1, wherein the first fixing structure has a first guiding surface and a second guiding surface, there is an acute angle between the first guiding surface and the second guiding surface, the second fixing structure has a third guiding surface and a fourth guiding surface, there is an acute angle between the third guiding surface and the fourth guiding surface, and the second guiding surface contacts the fourth guiding surface when the first fixing structure and the second fixing structure are locked with each other.

5. The cover module according to claim 1, wherein a material of the body is polycarbonate (PC), acrylonitrile-butadiene-styrene terpolymer (ABS), or metal.

6. The cover module according to claim 1, wherein a material of the flexible connecting element is rubber.

7. The cover module according to claim 1, wherein the body is a casing of a part of the electronic device.

8. The cover module according to claim 1, wherein the body, the flip cover, and the flexible connecting element are formed integrally.

9. The cover module according to claim 1, wherein the flip cover further has a plurality of protruding structures corresponding to the second fixing structure, and when the first fixing structure and the second fixing structure are locked with each other, each of the protruding structures hides both the first fixing structure and the second fixing structure.

10. The cover module according to claim 1, wherein a material of a part of the flip cover and a part of the body is rubber.

11. The cover module according to claim 1, wherein the flip cover comprises a supporting structure for enhancing an intensity of the flip cover.

12. The cover module according to claim 1, wherein the flexible connecting element is connected to a surface of the body and a surface of the flip cover.

* * * * *